US006745781B2

(12) United States Patent
Gueret

(10) Patent No.: US 6,745,781 B2
(45) Date of Patent: Jun. 8, 2004

(54) DISPENSER ENDPIECE COMPRISING TWO ASSEMBLED-TOGETHER PARTS AND A COATING OF FLOCKING

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 82 days.

(21) Appl. No.: 09/884,178

(22) Filed: Jun. 18, 2001

(65) Prior Publication Data

US 2002/0007839 A1 Jan. 24, 2002

(30) Foreign Application Priority Data

Jun. 28, 2000 (FR) ..... 00 08309

(51) Int. Cl.[7] ..... A45D 40/26
(52) U.S. Cl. ..... 132/320; 401/266
(58) Field of Search ..... 132/74.5, 317, 132/318, 320; 401/172, 173, 174, 175, 205, 263, 266, 277; 206/385; 222/2, 187, 631, 390

(56) References Cited

U.S. PATENT DOCUMENTS

| | | | | |
|---|---|---|---|---|
| 3,179,972 A | | 4/1965 | Fillmore | |
| 3,807,881 A | | 4/1974 | Seidler | |
| 3,825,021 A | | 7/1974 | Seidler | |
| 4,368,746 A | | 1/1983 | Spatz | |
| 4,772,148 A | | 9/1988 | Buschemeyer | |
| 4,902,155 A | | 2/1990 | Buschemeyer | |
| 5,131,773 A | * | 7/1992 | Gueret | 401/68 |
| 5,199,808 A | | 4/1993 | Gueret | 401/133 |
| 5,738,067 A | | 4/1998 | Landwehr et al. | 132/320 |
| 5,772,347 A | | 6/1998 | Gueret | |
| 5,797,692 A | | 8/1998 | Poole et al. | |
| 5,851,079 A | * | 12/1998 | Horstman et al. | 401/174 |
| 5,908,256 A | | 6/1999 | Bernstein | |
| 6,076,534 A | * | 6/2000 | Gueret | 132/320 |
| 6,099,184 A | | 8/2000 | Koptis | |
| 6,309,128 B1 | | 10/2001 | Griebel et al. | |
| 6,450,722 B1 | * | 9/2002 | Ruschke et al. | 401/266 |

FOREIGN PATENT DOCUMENTS

| | | |
|---|---|---|
| EP | 0 245 983 A2 | 11/1987 |
| EP | 0 732 273 A1 | 9/1996 |
| EP | 1 044 625 A1 | 10/2000 |
| FR | 2 727 608 A | 6/1996 |
| FR | 2 773 959 | 7/1999 |

OTHER PUBLICATIONS

French Search Report dated Mar. 21, 2001.

* cited by examiner

*Primary Examiner*—Eduardo C. Robert
*Assistant Examiner*—David C Comstock
(74) *Attorney, Agent, or Firm*—Oblon, Spivak, McClelland, Maier & Neustadt, P.C.

(57) ABSTRACT

An endpiece for applying a cosmetic or care product, the endpiece comprising a first part assembled with a second part, one of the two parts defining at least part of an applicator surface suitable for being fed with substance by at least one orifice of the endpiece, the second part having a coating of flocking extending:

at least to an edge portion of said second part, said edge portion being substantially in contact with a non-flocked corresponding edge portion of the first part; and/or to a line situated substantially in contact with a non-flocked corresponding edge portion of the first part, the surface of the second part to which the flocking bristles are attached being set back from the outer surface of the edge portion of the first part.

40 Claims, 5 Drawing Sheets

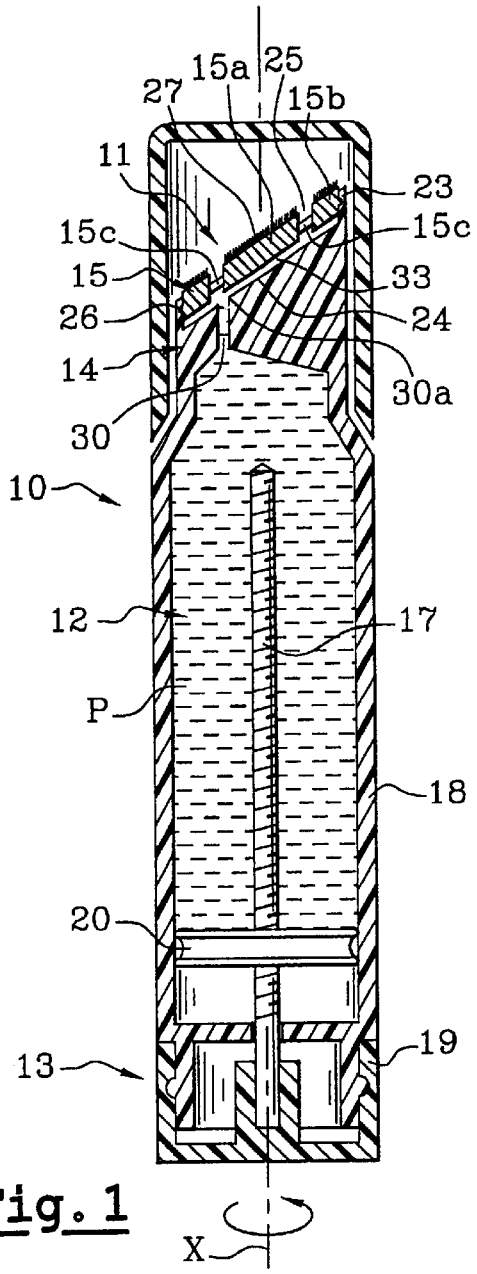
Fig. 1
Fig. 2
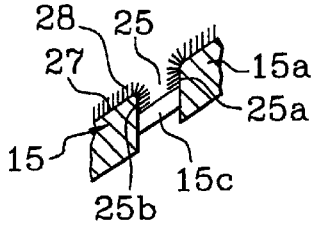
Fig. 3
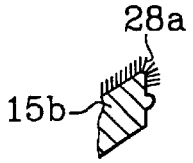
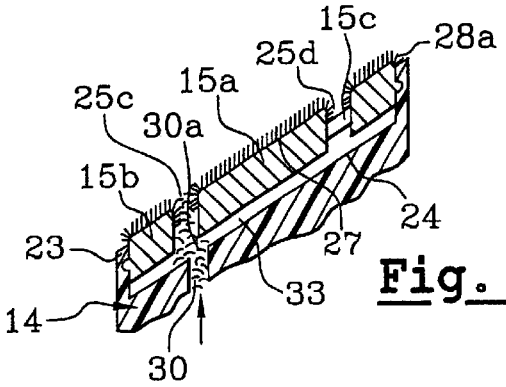
Fig. 4
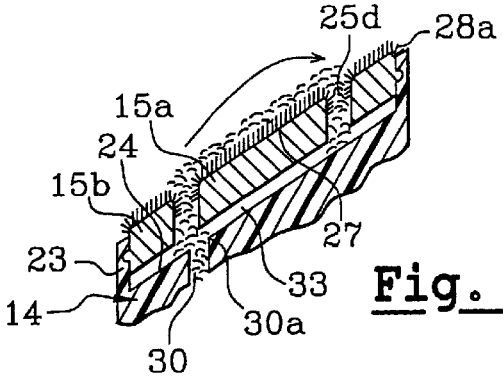
Fig. 6
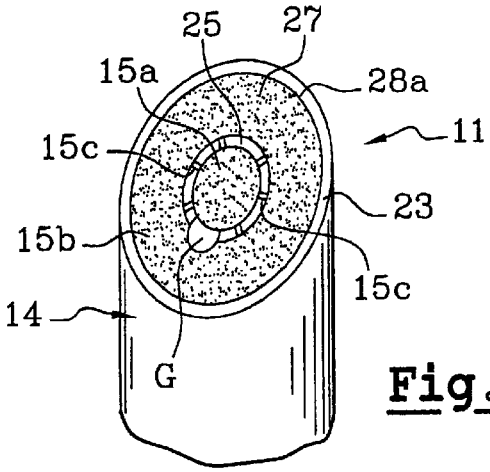
Fig. 5
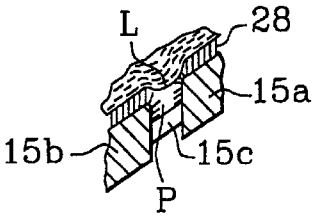
Fig. 7

Fig. 18
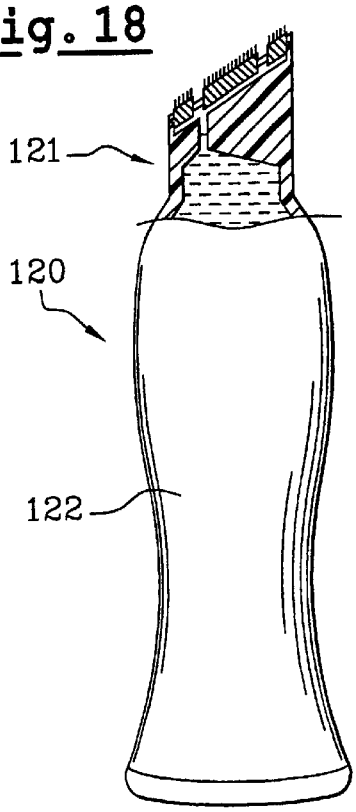
Fig. 19
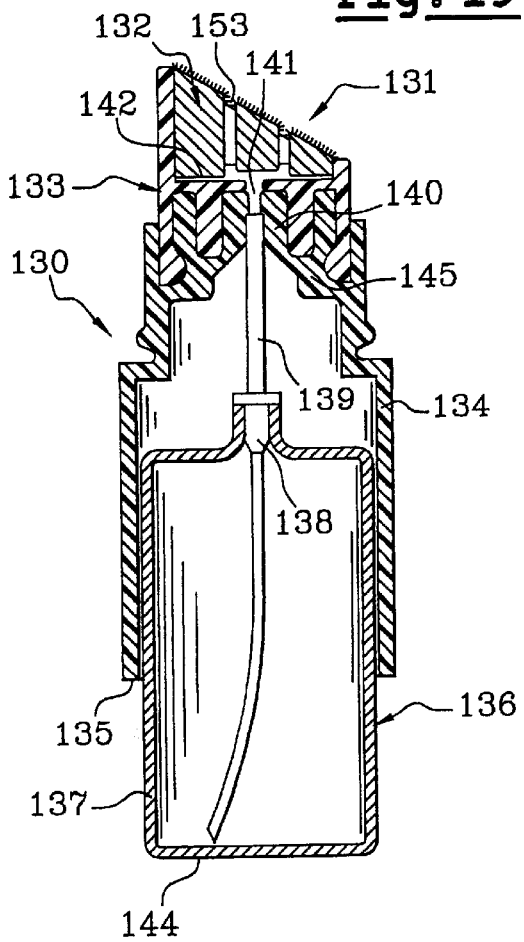
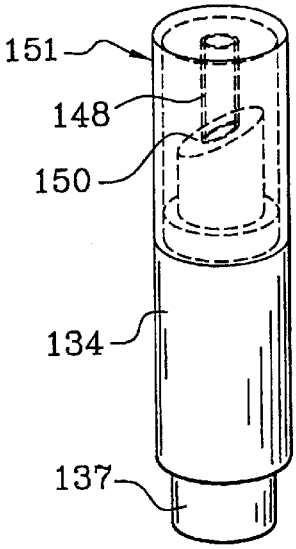
Fig. 20
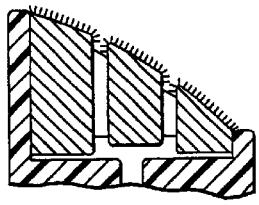
Fig. 21
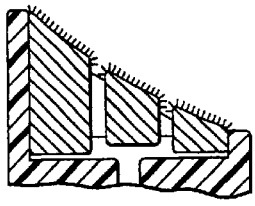
Fig. 22
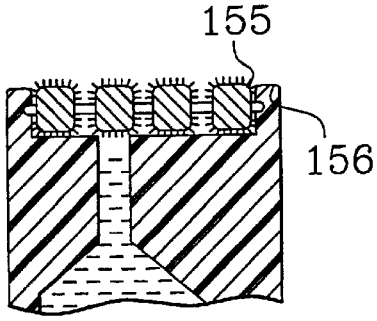
Fig. 23

DISPENSER ENDPIECE COMPRISING TWO ASSEMBLED-TOGETHER PARTS AND A COATING OF FLOCKING

The present invention relates to applying a cosmetic or care product, in particular on the lips or the eyelids.

BACKGROUND OF THE INVENTION

It is known to flock applicator endpieces in order to enable them to retain more substance and to increase comfort at the time of application.

To make a flocked endpiece, it is known to begin by depositing adhesive thereon, and subsequently to deposit short bristles by electrostatic means.

It is difficult to obtain a coating of flocking having a sharp outline.

Unfortunately, the lack of a sharp outline is unattractive in appearance and makes it more difficult to apply makeup neatly.

OBJECTS AND SUMMARY OF THE INVENTION

The invention seeks in particular to solve the above-mentioned problem.

An object of the present invention is thus to provide an endpiece that is easy to manufacture, that is capable of defining an applicator surface that is suitable for making up neatly, and that is comfortable to use.

The endpiece of the invention comprises a first part assembled with a second part, one of the two parts defining at least part of an applicator surface suitable for being fed with substance by at least one orifice of the endpiece, the second part having a coating of flocking extending:

- at least to an edge of said second part, said edge being substantially in contact with a non-flocked corresponding edge of the first part; and/or
- to a line situated substantially in contact with a non-flocked corresponding edge of the first part, the surface of the second part to which the flocking bristles are attached being set back from the outer surface of the edge of the first part.

The term "edge substantially in contact" is used to mean edges that touch or that are in the immediate vicinity of each other, given manufacturing tolerances.

The invention makes it possible to obtain a coating of flocking that has a sharp outline, thereby improving the appearance of the endpiece and making it possible to improve makeup quality.

In addition, using two assembled-together parts makes it easier to make the coating of flocking since one of said parts can be flocked separately more easily, possibly with reduced risk of plugging any orifices used for feeding substance to the coating of flocking.

In a particular embodiment, the second part has a coating of flocking extending at least to an edge of said second part, said edge being substantially in contact with a non-flocked corresponding edge of the first part, the edge of the second part being defined by a ridge.

In a particular embodiment, the second part has a coating of flocking extending at least to an edge of said second part, said edge being substantially in contact with a non-flocked corresponding edge of the first part, the edge of said second part being defined by the free edge thereof.

In a particular embodiment, the second part has a coating of flocking extending to a line situated substantially in contact with a non-flocked corresponding edge of the first part, the surface of the second part to which the bristles of the flocking are attached being set back from the outer surface of the edge portion of the first part.

The envelope surface of the coating of flocking can be situated substantially in continuity with the outside surface of the edge of the first part.

The envelope surface of the coating of flocking can also be substantially parallel to an axis of the endpiece, or it can extend transversely relative to an axis of the endpiece.

The coating of flocking need not be covered by the edge of the first part.

The applicator surface can be defined by the second part which can be the fitted part.

The second part can have an outside face that is entirely flocked, defining the applicator surface.

The applicator surface can also be defined at least in part by the first part.

In a particular embodiment, the first part has a housing in which the second part is fixed.

This housing is preferably of a shape which is complementary to the shape of the second part.

The first part may include an outer annular skirt that is not flocked.

Preferably, the first and second parts have sealing means enabling the two parts to be assembled together in leakproof manner.

The two parts can be fixed one in the other by snap-fastening.

In a variant, the two parts can be fixed one to the other by heat-sealing, adhesive, or hot-setting.

In a preferred embodiment, the second part includes a grid or is constituted by a grid.

Advantageously, the second part includes an annular groove or cavity extending along a closed curve, possibly other than circular.

Preferably, this groove or cavity does not present any narrowing of its section at its outer opening, thus enabling the surface of the skin or the lips to penetrate more deeply therein, where appropriate, so as to extract substance.

In a particular embodiment, the second part is of varying height so as to define a chamfered applicator surface.

The second part can have an element that co-operates with the first part to form a check valve suitable for moving under drive from pressure in the substance.

The valve serves to protect the substance upstream from the endpiece from becoming dirtied and from oxidation.

The first part can include a central portion forming a jet-deflector, situated in or facing a substance-feed passage.

In a variant, the second part includes a jet-deflector-forming portion situated facing a substance-feed passage.

The applicator surface may comprise a chamfered surface and a side surface extending around said chamfered surface, said chamfered and side surfaces being flocked.

The second part can include one or more grooves or cavities and can be covered by a coating of flocking that extends over at least a fraction of the inside surface of said grooves or cavities.

Advantageously, the orifice(s) into which the substance feed passages open out in the bottom(s) of said groove(s) or cavity(ies) is/are set back from the applicator surface by a distance of at least 1 millimeter (mm).

The groove(s) or cavity(ies) can be flocked over a fraction of its(their) height from the applicator surface without running the risk of the coating of flocking interfering excessively with the flow of substance, since the groove(s) or cavity(ies) in question can be relatively wide, e.g. having opposite edges that are more than 1 mm apart, the distance between said edges preferably being selected in such a manner that the surface of the lips or of the skin can reach substance contained inside.

The presence of the groove(s) or the cavity(ies) is also advantageous in that it makes it possible to absorb any excess substance on the applicator surface and avoid substance being expelled from the applicator surface when the endpiece is brought into contact with the surface to be made up or treated.

In a particular embodiment, the second part is in the form of a sleeve covered by a coating of flocking on a front face and on at least one of its inner and outer side surfaces, preferably over its entire outer surface and over a fraction of its inner side surface.

The second part can be made out of flexible material.

More generally, the first part and/or the second part can be made out of one or more plastics materials selected from the following list: ethylene-propylene diene monomer (EPDM) elastomer, nitrile rubber, latex, thermoplastic elastomer of polystyrene (PS), polyethylene terephthalate (PET), polyurethane (PU), ethylene vinyl acetate (EVA), polyvinyl chloride (PVC), "Polynorborden", or a relatively rigid thermoplastic material such as polypropylene (PP), polyethylene (PE), PS, PET, polycarbonate (PC), etc.

In a particular embodiment, the coating of flocking extends to an edge that presents undulations.

In a particular embodiment, the second part includes a central region and a peripheral region interconnected by bridges of material.

These bridges of material need not be flocked, particularly if they are set back significantly from the applicator surface.

The second part can also be completely flocked.

In a particular embodiment, the endpiece has at least one orifice that is off-center, for feeding substance to the applicator surface.

In a particular embodiment, the second part is off-center relative to the first, thus making it possible, where appropriate, to provide an endpiece that is more ergonomic.

The second part can cooperate with the first to provide a gap allowing the substance to flow, and even flow back, under the second part.

The invention also provides a packaging and applicator device including an endpiece as defined above together with a reservoir of substance for containing the substance that is to feed the endpiece.

The reservoir can be formed by a body that is integral with the first part of the endpiece.

The device can include a piston for exerting pressure on the substance contained in the reservoir for the purpose of dispensing it.

The reservoir can also include a compressible wall enabling the substance to be dispensed by exerting pressure thereon, e.g. by the user exerting pressure.

The device can also include a pump.

The reservoir can be removable, in which case it can constitute a refill.

When the device includes a pump, the reservoir is advantageously movable relative to the remainder of the device so as to actuate the pump in order to dispense a quantity of the substance.

Advantageously, the device includes a closure cap containing at least one internal shutter member suitable for covering the substance outlet orifice(s) when it is in place on the endpiece.

The invention also provides a method of manufacturing the endpiece as defined above, wherein the second part is made with a coating of flocking and with at least one groove or cavity without piercing said groove or cavity after flocking has been performed and without inserting an insert in said groove or cavity during flocking.

Thus, the endpiece is relatively simple to manufacture.

In addition, by not piercing the second portion after the flocking has been performed, no roughnesses or starters for peeling off the coating of flocking are formed, which is particularly important when the second part is flexible, e.g. because it is made of elastomer.

BRIEF DESCRIPTION OF THE DRAWINGS

The invention will be better understood on reading the following detailed description of various non-limiting embodiments of the invention, and on examining the accompanying drawings, in which:

FIG. 1 is a diagrammatic axial section view of a packaging and applicator device of the invention;

FIG. 2 shows a detail of FIG. 1;

FIG. 3 shows a portion of the periphery of the grid in isolation;

FIG. 4 is a fragmentary view of the endpiece showing how it is fed with substance;

FIG. 5 is a diagrammatic perspective view of the endpiece;

FIG. 6 shows how substance is recovered by the groove or cavity of the endpiece;

FIG. 7 shows how the skin or the mucous membrane of the lips is deformed on coming into contact with the endpiece and how it comes into contact with the substance contained in a groove or cavity of the endpiece;

FIGS. 18 to 20 show various ways in which the substance can be packaged;

FIGS. 21 to 22 show endpieces with applicator surfaces that are respectively outwardly convex and concave;

FIG. 23 shows an endpiece in which the second part is flocked in its entirety;

MORE DETAILED DESCRIPTION

Figure 8:
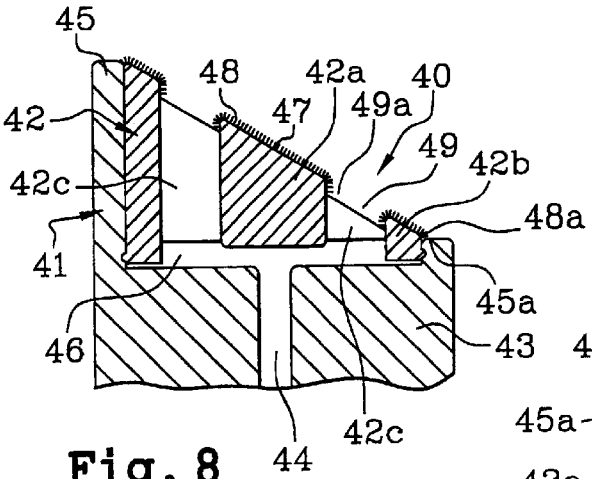
FIGS. 8 to 10 are diagrammatic fragmentary axial section views showing another embodiment of the invention.

FIG. 1 shows a packaging and applicator device comprising an endpiece 11 for applying substance, a body 18 defining a reservoir 12 containing substance in the form of a cosmetic or a care product P, and a mechanism 13 enabling a quantity of the substance to be dispensed.

By way of example, the viscosity of the substance P can lie in the range 0.6 Pascal seconds (Pa.s) to 17 Pa.s.

The endpiece 11 comprises a first part or base 14 having a second part or grid 15 fitted thereto, in a manner explained below.

The above-mentioned mechanism 13 has a threaded rod 17 that turns in a bore in the body 18 and that is suitable for being turned by means of a drive knob 19 situated at the bottom of the device 10.

A piston 20 meshes with the rod 17 and can move in translation in contact with the body 18 while being prevented from rotating relative thereto so that turning the knob 19 causes the piston 20 to move axially, thereby serving to expel a quantity of substance through a passage 30 provided at the top of the body 18.

The base 14 of the endpiece 11 in this example is made integrally with the body 18 by molding a relatively rigid plastics material, and it includes a tubular skirt 23 surrounding a housing 24 in which the grid 15 is fixed.

It is thus the base 14 through which the grid 15 is fed with substance.

The grid 15 can be fixed onto the base 14 in various different ways without going beyond the ambit of the present invention.

For example, as shown in the drawing, this can be done by means of a projection 26 formed on the grid 15 which snap-fastens in leakproof manner in a complementary annular groove formed in the inside surface of the skirt 23.

In the example described, the grid 15 has a central region 15*a* and a peripheral region 15*b* that are interconnected by bridges of material 15*c*.

The regions 15*a* and 15*b* leave between them an annular groove 25 across which the bridges 15*c* extend, which bridges leave passages between one another via which the substance can pass through the grid 15.

On its outside face 27, the grid 15 has a coating of flocking 28, which coating covers the side surfaces 25*a* and 25*b* of the grid 15 defining the groove 25 over a fraction of their height, as can be seen in FIG. 2.

In this case, the outside face 27 is plane and extends obliquely relative to the axis X of the rod 17, such that the endpiece 11 presents a generally chamfered shape.

In the example described, the bridges 15*c* are set back from the outside surface 27 and the coating of flocking 28 covers the side surfaces 25*a* and 25*b* over a height that is less than the distance between the outside face 27 and the bridges 15*c*.

To make the coating of flocking 28, the grid 15 is coated in adhesive on its outside face 27 by being immersed completely or in part by a bath of adhesive, and then bristles are deposited electrostatically onto those regions of the grid 15 that have been thus coated in adhesive.

The adhesive used is selected to present viscosity and surface tension which avoid films forming across the openings through the grid 15 so as to ensure that they are not closed.

The diameters, lengths, and natures of the bristles can be various or they can be substantially identical, depending on the substance that is to be applied.

By way of example, the bristles can be made in particular of polyamide, rayon, polyester, viscose, or cotton.

The length of the bristles can be 0.5 mm, or longer, for example.

The coating of flocking covers the outside end edge of the grid 15 over a certain height, as can be seen in FIG. 3.

The grid 15 is fed with substance via the above-mentioned passage 30, which puts the housing 24 into communication with the inside of the reservoir 12.

This passage 30 opens out via an orifice 30*a* in the bottom of the housing 24 in register with a bottom region 25*c* of the groove 25.

As a result, when the user turns the knob 19, the substance begins to be expelled via the bottom region 25*c* of the annular groove 25, as shown in FIG. 4, even though a gap 33 can exist between the grid 15 and the bottom of housing 24.

Thus, the user can cause a drop G of the substance P to be delivered in a non-central location of the outside face 27, as shown in FIG. 5.

In this case, the drop G is situated in the bottom region of the outside face 27.

Since the annular groove 25 is filled only partially with the substance P when the substance is expelled via the bottom region 25*c*, the top region 25*d* can absorb substance while it is being spread over the applicator surface, as shown in FIG. 6.

The fact that the substance P is expelled onto the outside face 27 in localized manner enables the user to control accurately, prior to application, how much substance is going to be loaded on the outside face 27.

Furthermore, the risk of the substance being in excess on the applicator surface is reduced because of the substance-absorption capacity of those regions of the annular groove 25 that are remote from the region through which the substance is delivered.

The gap 33 can be chosen to be large enough to allow a certain amount of substance to circulate under the grid.

Circulation of the substance from the passage 30 towards the region 25*c* of the grove 25 tends, providing the substance is moving fast enough, to establish an effect whereby the substance contained in the gap 33 is entrained and sucked out, so that this substance is mixed with the substance that is being delivered to the region 25*c*, thereby serving to empty the region 25*d*, at least in part.

Thus, on each new delivery of substance from the reservoir 12, the region 25*d* can accept some of the substance that is present in excess on the applicator surface, should that be necessary.

Furthermore, causing the substance to circulate helps prevent any substance remaining for too long a time in the endpiece without being used, thereby preventing deterioration thereof.

As in the example described, the width of the groove 25 is preferably selected in such a manner that the surface of the skin or of the mucous membranes in contact with the endpiece 11 at the time substance is applied can deform slightly and dip into the substance that is contained in the groove, as shown in FIG. 7.

In the example described, it will be observed that the coating of flocking 28 extends at least to the peripheral edge 28*a* of the grid 15, as defined by a ridge, said edge 28*a* being in contact with the non-flocked top end of the skirt 23, thus making it possible to obtain flocking having an outline that is sharp when seen from the outside.

It will also be observed that the risk of the passage feeding the applicator surface being blocked by the coating of flocking is reduced, given the relatively large dimensions of the annular groove 25 and the fact that the orifice 30*a* is not exposed to the adhesive used for applying flocking to the grid 15.

Naturally, it is possible to use an endpiece having configurations that are different without going beyond the ambit of the present invention.

Figure 9:
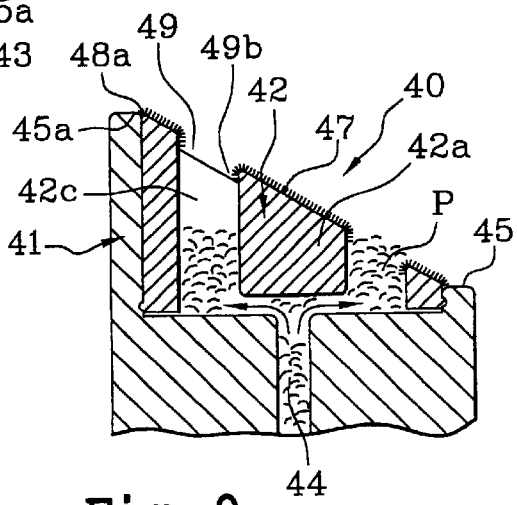
Figure 10:
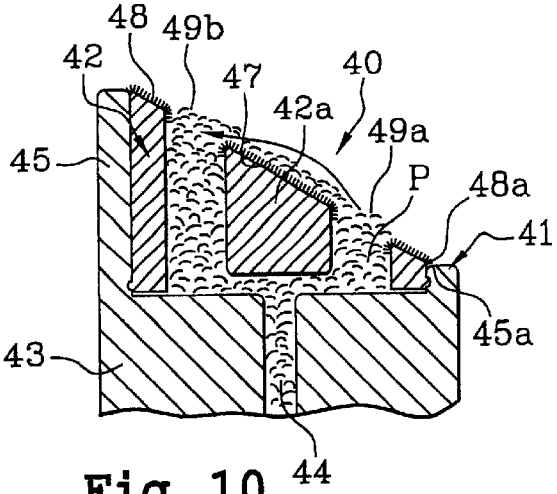

By way of example, FIGS. 8 to 10 show an endpiece 40 comprising a support part or base 41 associated with a fitted element or grid 42.

The support part 41 comprises a bottom portion 43 through which a central passage 44 passes that is in communication with the reservoir containing the substance, and a top portion 45 serving to define a housing 46 in which the fitted part 42 is secured.

This top part 45 is in the form of a tubular skirt of varying height, the top end of this tubular skirt being substantially tangential to a plane that is inclined relative to the axis of the endpiece.

The fitted part 42 has an outside face 47 for defining an applicator surface, which outside face is covered in a coating of flocking 48.

The endpiece 40 is generally chamfered in shape.

The fitted part 42 has a central portion 42*a* and a peripheral portion 42*b* which are interconnected by bridges of material 42*c*, like the above-described grid 15.

The fitted portion 42 is secured in the housing 46 by snap-fastening, as in the preceding embodiment.

The central portion 42*a* co-operates with the peripheral portion 42*b* to define an annular groove 49.

The coating of flocking 48 extends somewhat into the annular groove 49, covering the ridges of the portions 42*a* and 42*b* on either side of said groove.

While substance is being dispensed, the substance is expelled in privileged manner via the bottom region 49*a* of the groove 49 because that is where the groove is of smaller height, as can be seen in FIG. 9.

The top region 49*b* of the groove 49 serves to recover any excess substance that might be found on the applicator surface 47, as shown in FIG. 10.

The central portion 42*a* acts as a jet-deflector given its position facing the passage 44.

The coating of flocking 48 extends to a peripheral edge 48*a* of the fitted part 42 defined by a ridge which is in contact with the non-flocked top end 45*a* of the tubular skirt 45.

Figure 11:
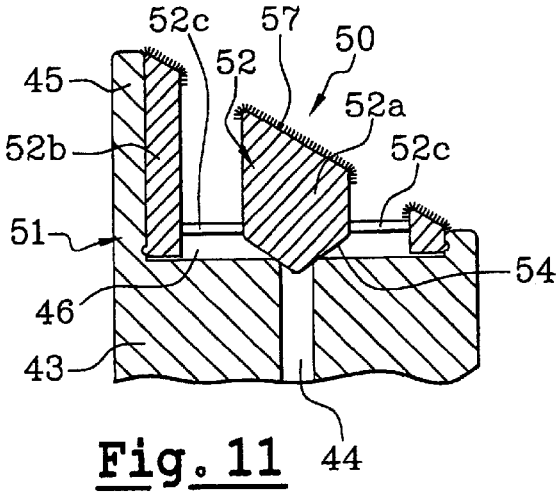
FIG. 11 is a fragmentary diagrammatic axial section view showing a variant embodiment.

FIG. 11 is a view analogous to the view of FIGS. 8 to 10, and it shows an endpiece 50 having a support part 51 identical to the support part 41 as described above, together with a fitted part 52.

The fitted part 52 has a central portion 52*a* and a peripheral portion 52*b* that are interconnected by bridges of material 52*c*.

The outside face 57 of the fitted part 52 defines an applicator surface.

The peripheral portion 52*b* is identical to the peripheral portion 42*b* as described above and it is fixed in the same manner to the support part 51.

The bottom of the central portion 52*a* presents a shutter-forming portion 54 which, in the rest state, presses against the bottom of the housing 46 so as to shut the passage 44 putting the housing 46 into communication with the supply of substance.

This serves to isolate the supply from ambient air except while the endpiece is being fed with substance.

The bridges 52*c* are made in such a manner as to leave a certain amount of freedom to the central portion 52*a* to move under the effect of pressure from the substance in the passage 44.

The shutter-forming portion 54 is shaped like a center punch so that when it moves away from the bottom of the housing 46, it leaves a passage for the substance to flow towards the applicator surface.

FIGS. 12 to 17 show various endpiece configurations so as to demonstrate that the invention is not limited to the two configurations described above.

Figure 12:
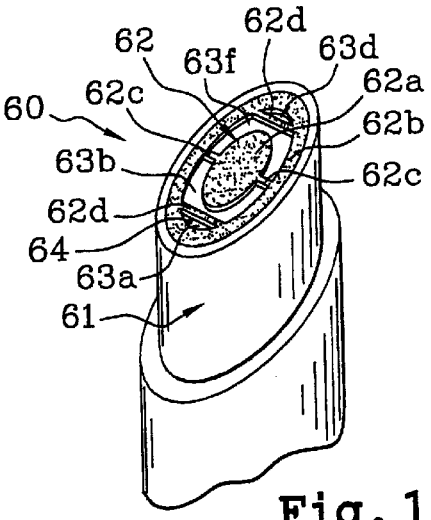
FIGS. 12 to 17 are diagrammatic perspective views showing various endpiece shapes.

Thus, FIG. 12 shows an endpiece 60 having a support part or base 61 which in this case is identical to the support part 14 described above, and a grid or fitted part 62 having a central portion 62*a* and a peripheral portion 62*b* united by bridges 62*c*.

The grid 62 has bottom and top bars 62*d* parallel to the bridges 62*c*.

The grid 62 defines a plurality of cavities 63*a*, 63*b*, 63*c*, and 63*d*, with the bottoms of the cavities being set back from the applicator surface.

The cavity 63*a* is formed between the peripheral portion 62*b* and the bottom bar 62*d*.

The cavity 63*b* is formed between the peripheral portion 62*b*, the bottom bar 62*d*, and the central portion 62*a*.

The cavity 63*c* is formed between the central portion 62*a*, the top bar 62*d*, and the peripheral portion 62*b*.

The cavity 63*d* is formed between the top bar 62*d* and the peripheral portion 62*b*.

An orifice 64 opens out into the bottom of the housing receiving the grid 62 in order to feed the applicator surface with substance.

In the example described, this orifice 64 opens out into the above-mentioned cavity 63*a*.

All of the cavities 63*a* to 63*d* communicate with one another beneath the grid 62.

Excess substance present on the applicator surface can be recovered by one of the cavities 63*b* to 63*d* in a manner similar to that which occurs in the above-described embodiments.

The entire outside face of the grid 62 is covered by a coating of flocking, which extends as far as the annular non-flocked skirt of the base 61 which surrounds the grid 62.

Figure 13:
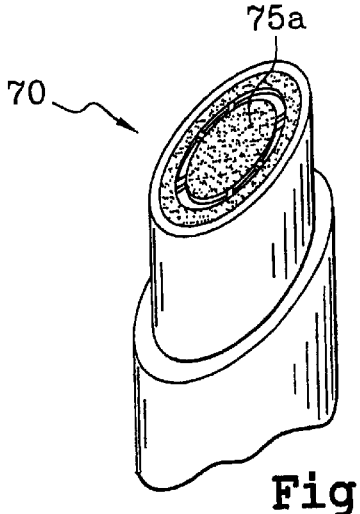

FIG. 13 shows an endpiece 70 which differs from the endpiece shown in FIG. 5 mainly by the fact that the central portion 15*a* is replaced by a central portion 75*a* of larger diameter, which occupies the major fraction of the applicator surface.

The outline of the grid where it joins the support part need not be circular.

Figure 15:
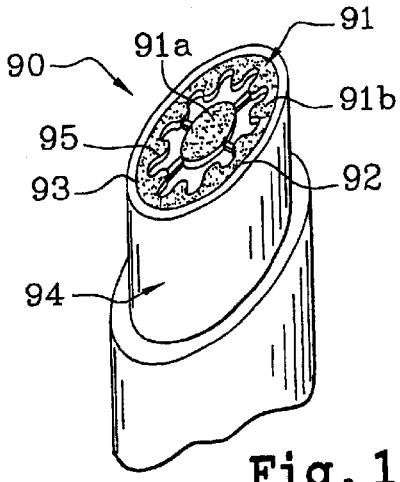

By way of example, FIG. 15 shows an endpiece 80 having a grid 81 fixed on a supporting part 82.

The support part 82 has a chamfered front face 83 and a housing opening out into said front face to receive the grid 81.

Figure 14:
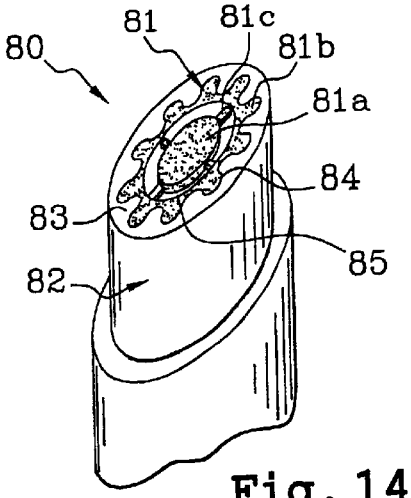

In FIG. 14, it can be seen that the grid 81 comprises a central portion 81*a* and a peripheral portion 81*b* interconnected by bridges of material 81*c*, the peripheral portion 81*b* having a coating of flocking as far as an edge 84 which presents undulations and which is situated in contact with a non-flocked corresponding edge 85 of complementary shape of the front face 83.

FIG. 15 shows an endpiece 90 that comprises a support part receiving a grid 91 having a central portion 91*a* and a peripheral portion 91*b*.

The peripheral portion 91*b* has a coating of flocking as far as its radially outer edge 92, which edge is in contact with the non-flocked edge 93 of the support part 94.

The peripheral portion 91*b* has an undulating edge 95 surrounding the central portion 91*a*.

Figure 16:
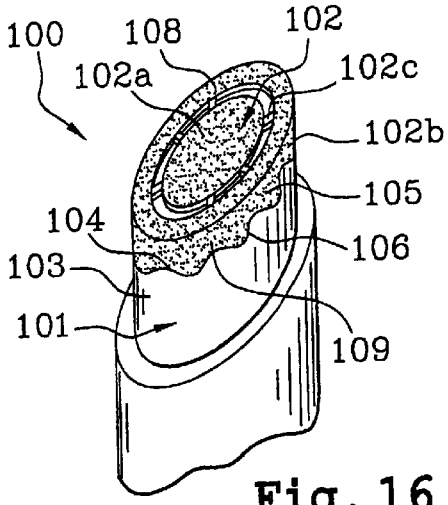

FIG. 16 shows an endpiece 100 having a support part 101 and a fitted part 102, the fitted apart having a central portion 102*a* and a peripheral portion 102*b* interconnected by bridges of material 102*c*.

The support part 101 has a tubular skirt 103 whose top edge 104 presents undulations.

The fitted part 102 also has a tubular skirt 105 whose bottom edge 106 presents a shape that is complementary to that of the edge 104, such that the two edges 104 and 106 come fully into contact with each other, as shown in FIG. 16.

The fitted part 102 has a coating of flocking both on its front face 108 and on its side surface 109.

This coating of flocking extends as far as the edge 106 and comes into contact with the non-flocked edge 104 of the support part. The edge 106 is a free edge of the fitted part.

It will be observed that because the flocked skirt 105 presses against the edge 104 of the support part, it is possible to obtain a coating of flocking that presents a sharp outline without there being any need to cover the skirt 105 in a mask.

The endpiece can be given other shapes as well, and the side surface of the endpiece need not be circularly symmetrical.

Figure 17:
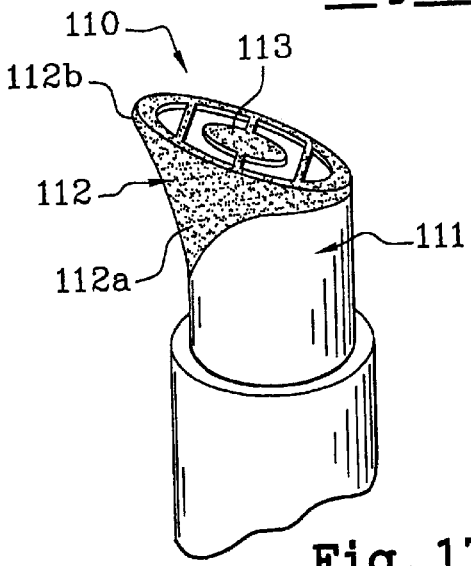

By way of example, FIG. 17 shows an endpiece 110 which has a support part 111 and a fitted part 112, the fitted part comprising a bottom portion 112*a* which comes into contact with the support part 111 and an offset portion 112*b* which is eccentric relative to the axis of the support part 111.

The fitted part 112 presents a top face 113 forming a chamfer. The entire outside surface of the fitted part 112 has a coating of flocking.

This coating of flocking extends to the non-flocked top edge of the support part 111.

The substance can be packaged and the applicator surface can be fed with substance in various other ways.

Thus, the piston and drive screw reservoir shown in FIG. 1 can be replaced by a reservoir having a deformable wall, as shown in FIG. 18.

This figure shows a packaging and applicator device 120 comprising an endpiece 121 identical to the endpiece 11 as described above, and a reservoir constituted by a compressible tube 122.

In this case, the base of the endpiece 121 is integrally formed with the tube, but in a variant it could itself be constituted by an element which is fitted to the tube.

As shown in FIG. 19, it is also possible to use a pump for feeding the applicator surface with substance.

In this figure, there can be seen a device 130 comprising a body 134 surmounted by an endpiece 131 carrying a grid 132 similar to the grid 42 described with reference to FIGS. 8 to 10, comprising an annular groove 153 and a support part 133 fixed on the body 134.

The bottom end 135 of the body 134 is open to receive a refill 136 comprising a reservoir 137 containing substance and a pump 138 having a hollow control rod 139.

The rod 139 is forced into a housing 140 situated in the top proton of the body 134.

This housing 140 includes a passage 141 opening out into the bottom of the housing 142 in the support part 133 in which the grid 132 is fixed.

While the pump 138 is at rest, the refill 136 projects beyond the bottom of the body 134.

By pressing on the bottom 144 of the reservoir 137, the user can urge the refill 136 towards the top portion 145 of the body 134, thereby actuating the rod 139 and causing a quantity of substance to be dispensed.

The substance leaving the top end of the rod 139 fees the applicator surface in a manner similar to that described with reference to FIGS. 8 to 10.

Advantageously, and as shown in FIG. 20, the device 130 has a closure cap 151 suitable for being fixed in sealed manner on the body 134 by snap-fastening for example, and comprising a bottom skirt 148 whose bottom edge 150 is suitable for engaging in the annular groove 153 so as to prevent any substance escaping and so as to protect any substance that may be present beneath the grid 132 and in the groove 153 from making contact with ambient air.

It is also possible to make the endpiece with a grid having an outside face that is outwardly convex, as shown in FIG. 21, or outwardly concave, as shown in FIG. 22.

It is also possible to make an endpiece whose grid is completely covered in flocking, as shown in FIG. 23.

In this figure, it can be seen that the coating of flocking extends over the outside face of the endpiece as far as the top peripheral edge 155 of the grid, and that this edge comes substantially into contact with the corresponding non-flocked edge 156 of the support part that receives the grid.

Although it is preferable for the surface that is used to apply the substance to be chamfered in order to make it easier to apply the substance and obtain neat makeup, it would not go beyond the ambit of the present invention for the applicator surface to extend perpendicularly to the axis of the support part, as shown in FIG. 23.

Furthermore, although it is also preferable for the substance to arrive preferentially on the applicator surface in a limited region of a groove or a cavity, as is the case for the devices described above, it would not go beyond the ambit of the present invention for the substance to arrive on the applicator surface in uniform manner.

Figure 24:
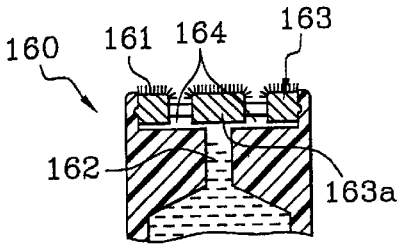
FIGS. 24 to 29 show other configurations of endpieces.

FIG. 24 shows an endpiece 160 including a grid 163 with a central region 163*a*.

The applicator surface 161 extends perpendicularly to the axis of the endpiece and the substance reaches the applicator surface 161 in uniform manner because the surface is fed via a passage 162 opening out into the center of the housing receiving the grid 163, which grid has passages 164 that are all identical and formed around the central region 163*a*.

The support part and the grid can be made in numerous other ways without going beyond the ambit of the present invention.

In particular, it is possible to make a jet-deflector integrally with the support part.

Figure 25:
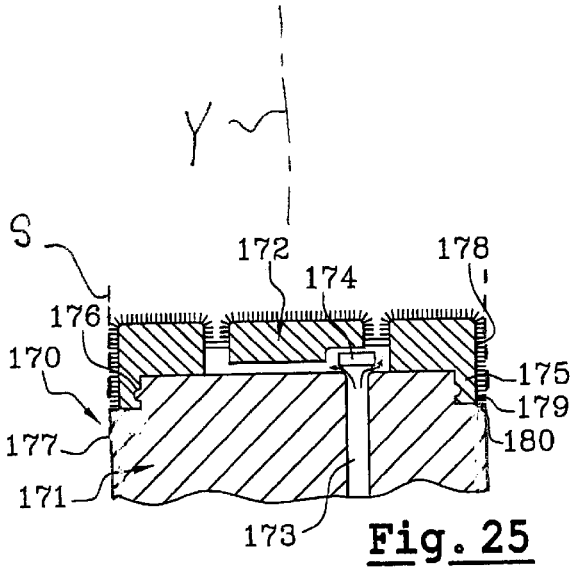

By way of example, FIG. 25 shows an endpiece 170 having a support part 171, and a grid 172 fitted thereon.

The support part 171 has a passage 173 for feeding the grid 172 with substance.

A jet-deflector 174 is integrally formed with the support part 171.

In this example it can be seen that the grid 172 is extended downwards at its periphery by a fixing skirt 175 which snap-fastens in leakproof manner on a bead 176 formed on the support part 171.

The bead is itself set back from the side surface 177 of the support part 171.

The outer surface of the skirt 175 is covered in a coating of flocking 178 which extends to its bottom edge 179 that comes into contact with a corresponding edge 180 of the non-flocked support part 171, which edge is defined by the step therein.

It will be observed that the envelope surface S defined by the free ends of the bristles of the coating of flocking on the skirt 175 is parallel to the axis Y of the endpiece and lies substantially in line with the side surface of the support part 171.

Figure 26:
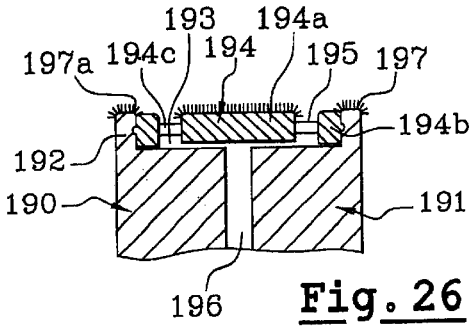

As shown in FIG. 26, it is also possible to make the endpiece with a grid that is not flocked or that is flocked over a portion only of its outside surface.

This figure shows an endpiece 190 having a support part 191 including an outer skirt 192 at its top, which skirt defines a housing 193 that receives a grid 194.

The grid 194 has a central portion 194*a* and a peripheral portion 194*b* which are interconnected by bridges of material 194*c*.

The central portion 194*a* is covered in a coating of flocking on its outside face.

The peripheral portion 194*b* is not flocked.

The top end of the skirt 192 is covered in a coating of flocking 197 that comes into contact with the non-flocked peripheral portion 194*b* of the grid 194.

In the example shown, the grid 194 is fed via a passage 196 opening out in register with the middle of the central portion 194*a*.

In a variant that is not shown, the grid is fed via a passage that is eccentric so as to cause substance to be expelled preferentially at a predetermined location of the applicator surface.

Figure 27:
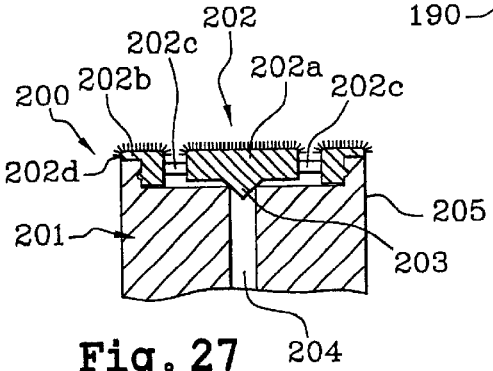

FIG. 27 shows an endpiece 200 comprising a support part 201 and a grid 202 fitted thereon.

The grid 202 has a central portion 202*a* whose bottom face presents a shutter-forming projection 203 suitable for closing a passage 204 that serves to feed the grid 202 with substance.

The central portion 202*a* is connected to a peripheral portion 202*b* by bridges of material 202*c*.

The peripheral portion 202*b* extends to an edge 202*d* which lies in line with the side surface 205 of the support part 201.

The grid 202 is covered in a coating of flocking on its front face and out as far as the edge 202*d*.

The side surface 205 is not flocked.

Figure 28:
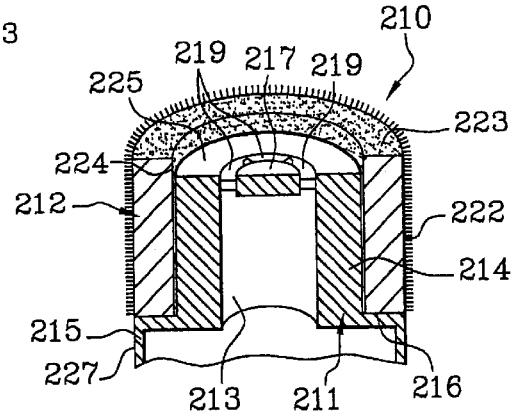

FIG. 28 shows an endpiece 210 having a support part 211, e.g. integrally formed with a reservoir-forming body 215, and a fitted part 212.

The support part 211 has a central passage 213 defined by a neck 214 forming a shoulder 216 where it connects with the body 215.

A jet-deflector 217 is integrally molded at the top end thereof.

The jet-deflector 217 closes the majority of the section of the passage 213 and defines passages 219 for the substance inside the neck 214.

The fitted part 212 is in the form of a sleeve whose outer side surface 222 and whose front surface 223 are covered in a coating of flocking.

The coating of flocking is also present on the portion of the inner side surface 224 that extends between the front face 223 and the top end 225 of the neck 214, with the height of the fitted part 212 being greater than the height of the neck 214.

The side surface 222 is positioned in line with the outer side surface 227 of the non-flocked body 215.

Figure 29:
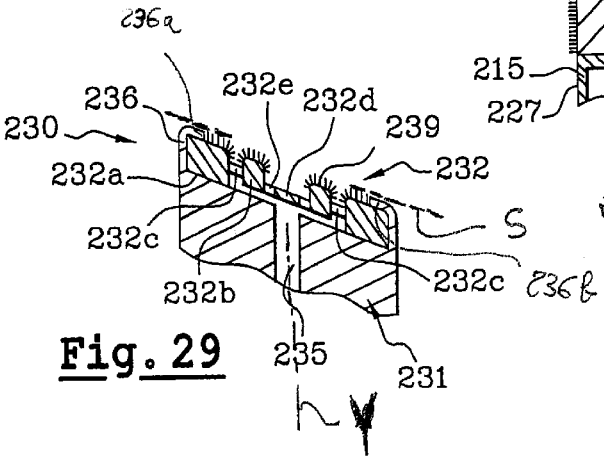
Figure 30:
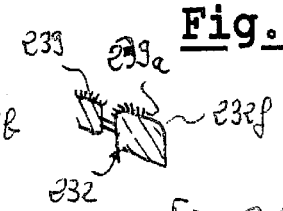
FIG. 30 shows the grid of the FIG. 29 endpiece in isolation.

FIG. 29 shows a distribution endpiece 230 having a support part 231 and a grid 232 fitted thereon.

The grid 232 has a peripheral portion 232*a* fixed on the support part 231, and an annular portion 232*b* connected to the peripheral portion 232*a* by bridges of material 232*c*.

A jet-deflector 232*d* is made in the middle of the annular portion 232*b* in register with a passage 235 through which substance is fed to the grid.

The jet-deflector 232*d* is connected by bridges of material 232*e* to the annular portion 232*b*.

The support part 231 has a skirt 236 defining a housing to receive the grid 232, the grid being held on the support part 231 by upsetting the top end of the skirt 236 while hot.

The coating of flocking 239 covering the grid 232 extends to a line 239*a* set back from the ridge 232*f* of the grid 232. This line 239*a* is situated substantially level with the free end 236*a* of the non-flocked skirt 236.

It can be seen that the envelope surface S defined by the free ends of the bristles of the coating of flocking on the grid 232 lies substantially in line with the outside surface 236*b* of the folded-down portion of the skirt 236.

Naturally, the invention is not limited to the embodiments described above.

In particular, the shape of the base or support part can be further modified as can the shape of the fitted part or grid without thereby going beyond the ambit of the present invention.

In particular, the various characteristics of the embodiment described above can be combined with one another.

The second portion of the endpiece can be made of flocked foam, for example.

What is claimed is:

1. An endpiece for applying a cosmetic or care product, the endpiece comprising a first part assembled with a second part, wherein said first part is an external part of said endpiece, one of the two parts defining at least part of an applicator surface suitable for being fed with substance by at least one orifice of the endpiece, the second part having a coating of flocking extending at least to an edge of said second part, said edge being substantially in contact with a non-flocked corresponding edge of the first part.

2. An endpiece according to claim 1, wherein the second part has a coating of flocking extending at least to an edge of said second part, said edge being substantially in contact with a non-flocked corresponding edge of the first part, and wherein the edge of the second part is defined by a ridge.

3. An endpiece according to claim 1, wherein the coating of flocking has an envelope surface lying substantially in continuity with the outer surface of the edge of the first part.

4. An endpiece according to claim 3, wherein the envelope surface is substantially parallel to an axis of the endpiece.

5. An endpiece according to claim 3, wherein the envelope surface extends transversely relative to an axis of the endpiece.

6. A An endpiece according to claim 1, wherein the coating of flocking is not overlapped by the edge of the first part.

7. An endpiece according to claim 6, wherein the applicator surface is defined by the second part.

8. An endpiece according to claim 7, wherein the second part has an entirely-flocked outside surface defining said applicator surface.

9. An endpiece according to claim 1, wherein the applicator surface is defined at least in part by the first part.

10. An endpiece according to claim 1, wherein the first part has a housing in which the second part is fixed.

11. An endpiece according to claim 10, wherein the first part includes a non-flocked outer annular skirt.

12. An endpiece according to claim 1, wherein the first and second parts have sealing means enabling the two parts to be assembled together in a leakproof manner.

13. An endpiece according to claim 1, wherein the two parts are fixed one in the other by snap-fastening.

14. An endpiece according to claim 1, wherein the two parts are fixed one in the other by heat-sealing, adhesive, or hot-setting.

15. An endpiece according to claim 1, wherein the second part includes a grid.

16. An endpiece according to claim 1, wherein the second part includes an annular groove or cavity extending along a closed curve.

17. An endpiece according to claim 1, wherein the second part is of varying height so as to define a chamfered applicator surface.

18. An endpiece according to claim 1, wherein the second part includes an element cooperating with the first part to form a check valve suitable for moving under drive from the pressure of the substance.

19. An endpiece according to claim 1, wherein the first part includes a central portion forming a jet-deflector, situated in or facing a substance-feed passage.

20. An endpiece according to claim 1, wherein the second part includes a jet-deflector-forming portion situated facing a substance-feed passage.

21. An endpiece according to claim 1, wherein the applicator surface comprises a chamfered surface and a side surface extending around said chamfered surface, said chamfered and side surfaces being flocked.

22. An endpiece according to claim 1, wherein the second part includes at least one groove or cavity, and wherein the second part is covered by a coating of flocking extending over at least a fraction of the inside surface of said groove or cavity.

23. An endpiece according to claim 1, wherein the second part is in the form of a sleeve covered by a coating of flocking on a front face and on at least one of its inner and outer side surfaces, preferably over its entire outer surface and over a fraction of its inner side surface.

24. An endpiece according to claim 1, wherein the coating of flocking extends to an edge presenting undulations.

25. An endpiece according to claim 1, wherein the second part includes a central portion and a peripheral portion interconnected by bridges of material.

26. An endpiece according to claim 25, wherein the bridges of material are not flocked.

27. An endpiece according to claim 1, wherein the second part is completely flocked.

28. An endpiece according to claim 1, including at least one off-center orifice to feed substance to the applicator surface.

29. An endpiece according to claim 1, wherein the second part is off-center relative to the first part.

30. An endpiece according to claim 1, wherein the second part is made of a flexible material.

31. An endpiece according to claim 1, wherein the second part cooperates with the first part to leave a gap enabling substance to flow or even flow back beneath the second part.

32. A packaging and applicator device, comprising an endpiece as defined in claim 1 and a reservoir of substance for containing the substance that is to feed the endpiece.

33. A device according to claim 32, wherein the reservoir is formed by a body made integrally with the first part of the endpiece.

34. A device according to claim 32, wherein the reservoir is removable.

35. A device according to claim 32, wherein the reservoir is movable relative to the remainder of the device so as to actuate a pump to dispense a quantity of substance.

36. A device according to claim 32, including a closure cap comprising at least one inner shutter element suitable for covering one or more outlet orifices for the substance in the endpiece when the cap is in place thereon.

37. A method of manufacturing an endpiece as defined in claim 1, wherein the second part is made with a coating of flocking and with at least one groove or cavity, without said groove or cavity being pierced after flocking and without an insert being inserted into said groove or cavity during flocking.

38. An endpiece for applying a cosmetic or care product, the endpiece comprising a first part assembled with a second part, one of the two parts defining at least part of an applicator surface suitable for being fed with substance by at least one orifice of the endpiece, the second part having a coating of flocking extending to a line situated substantially in contact with a non-flocked corresponding edge of the first part, the second part being fixed inside the first part by snap-fastening.

39. An endpiece for applying a cosmetic or care product, the endpiece comprising a first part assembled with a second part, one of the two parts defining at least part of an applicator surface suitable for being fed with substance by at least one orifice of the endpiece, the second part having a coating of flocking extending to a line situated substantially in contact with a non-flocked corresponding edge of the first part, the second part including an annular groove.

40. An endpiece for applying a cosmetic or care product, the endpiece comprising a first part assembled with a second part, wherein said first part is an external part of said endpiece, one of the two parts defining at least part of an applicator surface suitable for being fed with substance by at least one orifice of the endpiece, the second part having a coating of flocking extending to a ridge situated substantially in contact with a non-flocked corresponding ridge of the first part.

* * * * *